US008765253B1

(12) United States Patent
Smaldone et al.

(10) Patent No.: US 8,765,253 B1
(45) Date of Patent: Jul. 1, 2014

(54) EXERCISE MAT

(75) Inventors: Patricia L. Smaldone, Portland, OR (US); Amy Lyttle, Portland, OR (US)

(73) Assignee: Nike, Inc., Beaverton, OR (US)

( * ) Notice: Subject to any disclaimer, the term of this patent is extended or adjusted under 35 U.S.C. 154(b) by 781 days.

(21) Appl. No.: 12/891,433

(22) Filed: Sep. 27, 2010

(51) Int. Cl.
*D04B 21/00* (2006.01)
*D04B 9/00* (2006.01)
*D04B 21/14* (2006.01)

(52) U.S. Cl.
USPC ..... 428/218; 442/312; 442/318; 442/304; 66/195; 66/196; 428/86

(58) Field of Classification Search
None
See application file for complete search history.

(56) References Cited

U.S. PATENT DOCUMENTS

| | | | | |
|---|---|---|---|---|
| 2,050,156 | A | 8/1936 | Borghetty | |
| 2,799,916 | A | 7/1957 | Hindle | |
| 4,883,279 | A * | 11/1989 | Sabo | 277/311 |
| 5,004,643 | A * | 4/1991 | Caldwell | 442/82 |
| 5,326,628 | A | 7/1994 | Takahata et al. | |
| 5,885,910 | A | 3/1999 | Graichen | |
| 6,017,831 | A | 1/2000 | Beardsley et al. | |
| 6,477,865 | B1 * | 11/2002 | Matsumoto | 66/195 |
| 6,779,369 | B2 * | 8/2004 | Shepherd | 66/196 |
| 6,871,516 | B2 | 3/2005 | Peeler et al. | |
| 7,001,318 | B2 * | 2/2006 | Su-Tuan | 482/148 |
| 7,426,840 | B2 * | 9/2008 | Sytz | 66/196 |
| 2004/0031534 | A1 | 2/2004 | Schwartz | |
| 2004/0202854 | A1 | 10/2004 | Esparza | |
| 2004/0250346 | A1 | 12/2004 | Vasishth | |
| 2006/0037163 | A1 * | 2/2006 | Steinway | 15/209.1 |
| 2006/0223395 | A1 | 10/2006 | Wang | |
| 2006/0287622 | A1 * | 12/2006 | Goodwin | 602/3 |
| 2007/0270069 | A1 | 11/2007 | Lee et al. | |

FOREIGN PATENT DOCUMENTS

| | | |
|---|---|---|
| JP | 2007168730 | 8/1996 |
| JP | 2003268658 | 9/2003 |
| JP | 8218243 | 7/2007 |

OTHER PUBLICATIONS

Three-Dimensionally Knit Spacer Fabrics: A Review of Production Techniques and Applications, Journal of Textile and Apparel, Technology and Management, p. 1-31, vol. 4, Issue 4, Summer 2005.

* cited by examiner

*Primary Examiner* — Angela Ortiz
*Assistant Examiner* — Shawnda McKinnon
(74) *Attorney, Agent, or Firm* — Plumsea Law Group, LLC

(57) ABSTRACT

An exercise mat can include a knit spacer fabric having a first ground fabric spaced apart from a second ground fabric in an uncompressed state. The exercise mat can be configured to be rolled up and compressed for storage and to expand into a planar spaced apart arrangement between the first and second ground fabrics for use. The knit spacer fabric can be formed from a plurality of knit polymeric threads and can include a first wall fabric extending between the first ground fabric and the second ground fabric. The first wall fabric can support the first ground fabric and the second ground fabric in a compressible spaced-apart configuration. The spacer fabric can include a traction-enhancing coating at an outer surface.

27 Claims, 11 Drawing Sheets

EXERCISE MAT

BACKGROUND

Conventional exercise mats are mats or pads designed to provide cushioning for the user during a variety of physical exercise activities. For example, exercise mats are often used at health clubs during group activities like aerobics classes and yoga sessions, as well as during individual workout routines like stretching and doing situps. These conventional mats are generally thick and heavy foam pads that are difficult to transport easily. As such, they are maintained at the facility near the point of use or, for personal use, typically stored at home or other location close to the point of use. They quickly gather dirt through frequent use by many different users and via exposure to sweat and other contaminants. As such, they require cleaning on a regular basis, such as a daily basis, and would often benefit from cleaning between gym uses. Further, the foam used in conventional exercise mats breaks down relatively quickly that necessitates frequent replacement of mats.

Some facilities provide paper towels and spray bottles for the users to clean mats and other gym equipment as needed and between uses, but not all facilities provide such materials and it can be inconvenient for a user to clean a mat immediately prior to use. Further, some facilities require industrial washers to wash their mats and only wash them about once per month or longer due to the need for industrial washers, and many facilities simply spray wash their mats about once per month or so because they do not have industrial washers or want to incur the expense of sending them out for industrial cleaning. It would be desirable for users to have the option of maintaining an exercise mat as a personal accessory or at the gym. However, it would be difficult for a user to transport and store and clean a conventional foam exercise mat of the large, bulky foam type. This type of conventional mat is also heavy and awkward to carry and transport.

Less-bulky personal exercise mats have been proposed that have been designed for user portability and personal use. However, these conventional personal mats provide much less cushioning than the larger foam pads kept at exercise facilities, and they are generally difficult or inconvenient to clean on a regular basis. They also rely primarily on additional foam padding as a cushioning mechanism. As such, they provide less cushioning than the conventional foam pads in order to allow for their easy portability and use as a personal accessory while suffering from some of the same disadvantages, such as relatively quick degradation.

One type of conventional personal exercise mat employs a foam core surrounded by a woven fabric case that a user can remove for cleaning. Although such a configuration can be easier to clean for the user, the removability of the outer covering from the inner core provides a construction having a less secure interface between the layers. As such, it can allow for slippage during intense use and can degrade more rapidly than a rigidly fixed construction due to greater movement between the layers during use. Further, these conventional mats can fail to provide adequate grip between the mat and the floor or the user. This is because the woven outer material provides less contact grip than foam materials provided at the outer layer of other constructions.

SUMMARY

The present invention is directed to a lightweight, machine washable and dryable, easily-handled and robust exercise mat that can be used as a personal accessory or by an exercise facility. In one configuration, an exercise mat can include a knit spacer fabric and a traction-enhancing coating. The knit spacer fabric can have a first base region, a second base region spaced apart from the first base region, and an intermediate spacer region disposed between the first base region and the second base region and having a plurality of intermediate filaments extending between the first and second base regions in a columnar arrangement and forming a field of columnar filaments for biasing the first base region apart from the second base region to a cushion thickness distance. In some arrangements, the knit spacer fabric can have a warp knit or circular knit construction. The traction-enhancing coating can be disposed at least one of the first and second base regions.

In some arrangements, an exercise mat can be configured to be rolled up and compressed while in the rolled up configuration and to expand into a spaced apart arrangement between a first ground fabric and a second ground fabric in a substantially planar configuration for use. The exercise mat can include an upper layer, a lower layer, and a three-dimensional knit spacer fabric formed from a plurality of polyester, nylon and/or combination polyester/nylon yarns. The three-dimensional knit spacer fabric can have a first ground fabric, a second ground fabric, and a first wall fabric extending between the first ground fabric and the second ground fabric that can support the first ground fabric and the second ground fabric in a compressible spaced-apart configuration.

These and various other advantages and features of novelty characterizing various aspects of the invention are pointed out with particularity in the appended claims. To gain an improved understanding of the advantages and features of novelty, however, reference may be made to the following descriptive matter and accompanying drawings that describe and illustrate various embodiments and concepts related to the aspects of the invention.

BRIEF DESCRIPTION OF THE DRAWINGS

The foregoing Summary, as well as the following Detailed Description, will be better understood when read in conjunction with the accompanying drawings.

DETAILED DESCRIPTION

Figure 1:
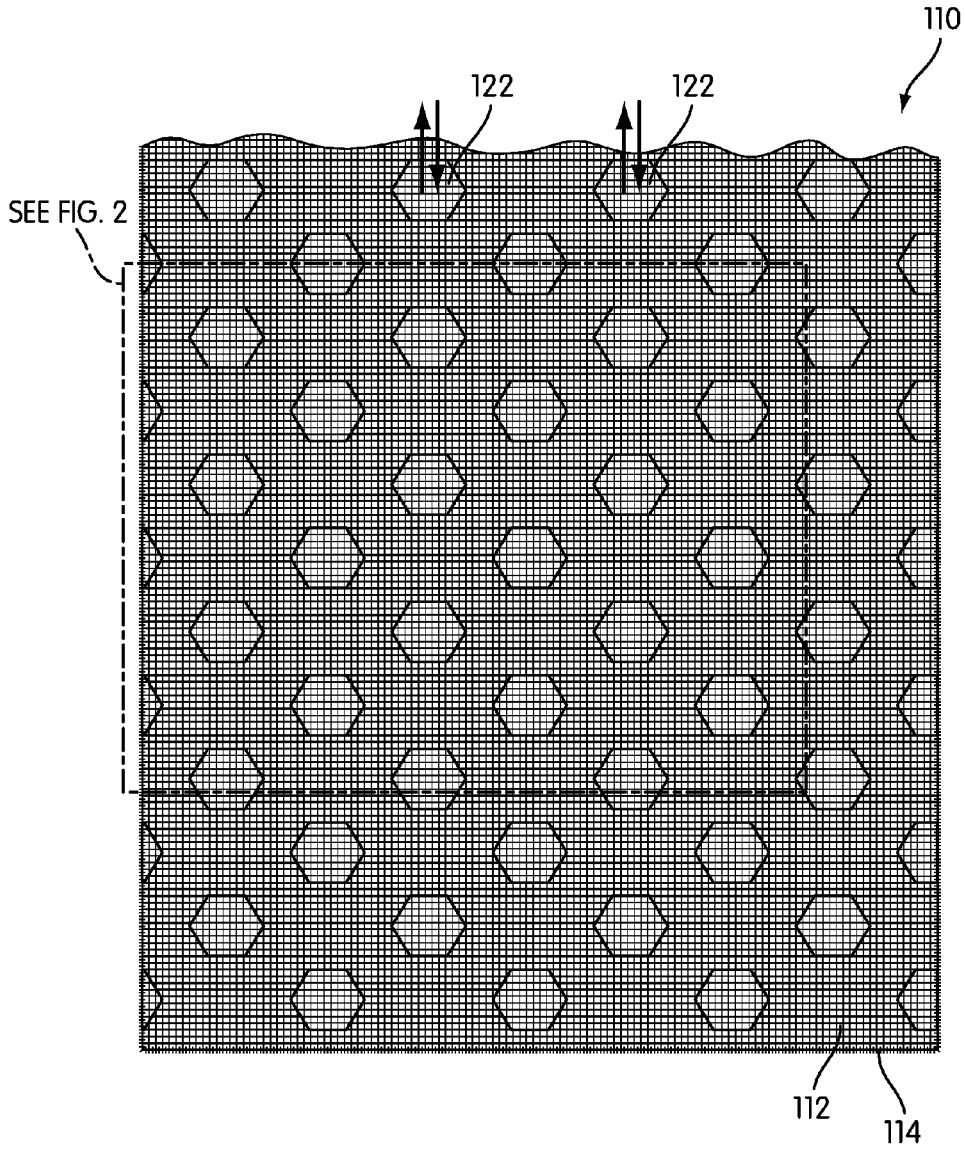
FIG. 1 is a top view of a portion of an exercise mat that illustrates features of the present invention.
Figure 2:
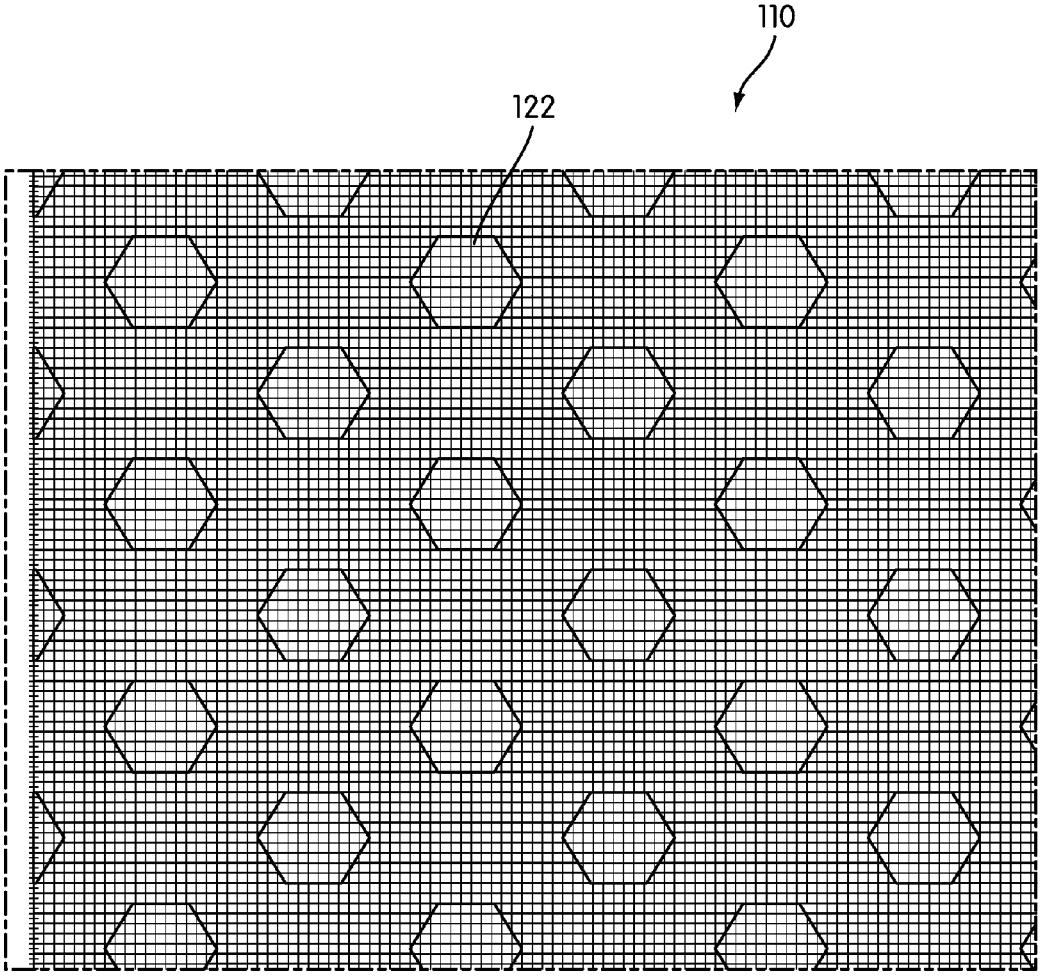
FIG. 2 is a close view of region 2 denoted in FIG. 1 for the exercise mat of FIG. 1.

The following discussion and accompanying figures disclose a lightweight and machine washable and dryable portable exercise mat that can be used as a personal accessory, as well as by gyms, large exercise facilities, smaller studios, etc. However, concepts related to the mat are not specifically limited to exercise mats and can be applicable to other types of mats. Further, concepts related to the mat are not limited to the features and arrangements of mats shown or discussed herein.

FIGS. 1-4 generally depict a lightweight and portable exercise mat 110 that includes various advantageous features permitting it to be used easily as a personal accessory, as well as by organizations such as gyms or exercise facilities, and providing for easy maintenance, storage and cleaning. For instance, exercise mat 110 is a robust exercise mat that can provide quality cushioning during use and a soft feel against the skin, while being lightweight and easy to store or be transported in a rolled up, compressed configuration. Further, exercise mat 110 can be easily cleaned by simply washing the mat in a conventional non-industrial (e.g., home) washing machine used for washing articles of clothing, as well as in industrial washing machines. Advantageously, mat 110 can also be machine dried in a conventional non-industrial (e.g., home) clothes dryer, as well as in an industrial dryer. In addition, exercise mat 110 can be configured to provide desirable features such as enhanced grip between the mat and ground and/or between the mat and the user, enhanced traction with the user's skin, lack of odor absorbency, and/or enhanced ventilation through the mat.

As shown in FIGS. 1-4, exercise mat 110 generally includes a lower layer 112, an upper layer 114 spaced apart from the lower layer in an uncompressed state, and an intermediate compressible support region 116. The exercise mat 110 includes at least one layer of spacer fabric 111, which generally forms the exercise mat 110 shown in FIGS. 1-4. The spacer fabric can be of various appropriate types and formations including the configurations shown in FIGS. 12-15. However, spacer fabric 111 preferably includes an intermediate region 116 formed of wall fabric 124 arranged in generally columnar arrangement extending between the upper layer 112 and the lower layer 114. The wall fabric 124 can include filaments extending between the lower and upper layers in various generally columnar configurations including rectangular, angled or triangular, and zigzag configurations (see FIGS. 12-15).

Figure 5:
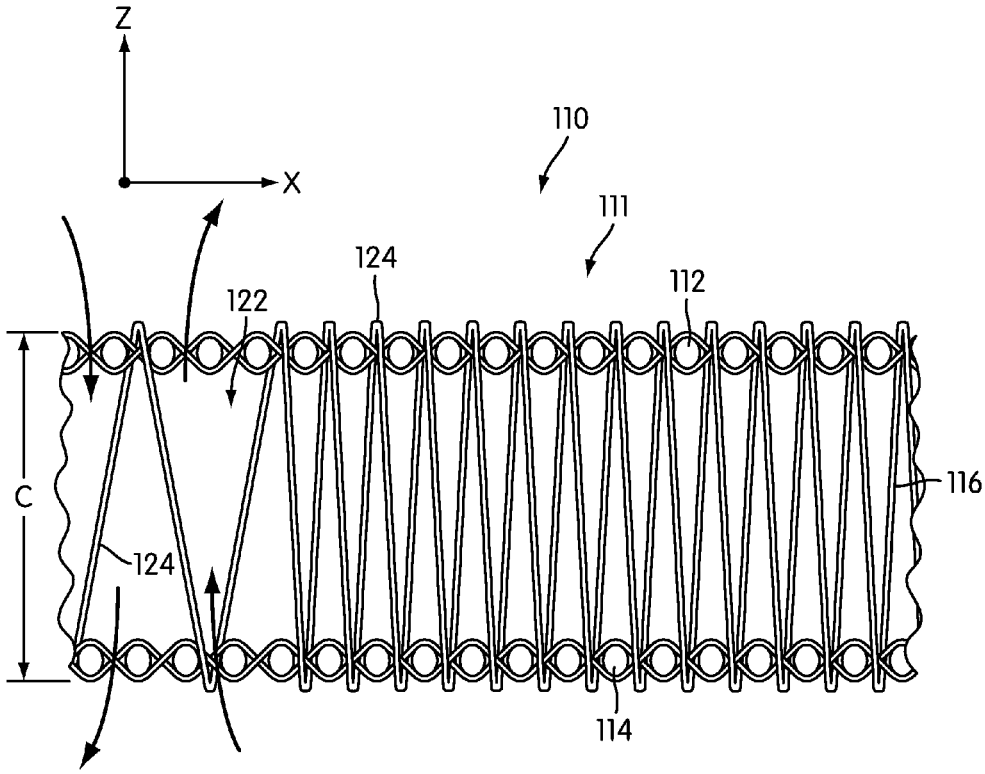
FIG. 5 is a cut away view taken from line Y-Y shown in FIG. 4 for one configuration of an exercise mat.

Whether rectangular oriented or angled, the generally columnar arrangement of wall fabric 124 provides a support structure that can bias the upper layer 112 apart from the lower layer 114 to a cushion thickness distance C shown in FIG. 5. The maximum cushion thickness C may currently be limited by mesh machine capability, and therefore could be up to and including the mesh maximum. A possible thickness range is between 2-10 mm; and an embodiment of the present invention has a thickness of approximately 5 mm. As such, the spacer fabric 111 can provide resilient cushioning for exercise mat 110 without the use of foam or other cushioning materials as a primary cushioning mechanism. The use of spacer fabric with exercise mat 110 can provide many advantages over conventional configurations based on the use of foam for a primary cushioning mechanism. For instance, spacer fabric 111 can have a much lighter weight than a foam-based cushioning mechanism that can provide comparable cushioning. This can allow exercise mat 110 to be easily transported and managed for use a personal accessory or at gyms or other exercise facilities.

Further, in addition to providing robust cushioning in the z-direction (FIG. 5) for use as an exercise mat, spacer fabric 111 can also be compressed to a much a greater degree than foam when rolled up and placed in a storage configuration. This is due to its ability to generally lay flat when exposed to significant sheer forces in the x-direction (FIG. 5). These types of sheer forces can be applied when the user rolls up the exercise mat, which can cause the wall fabric 116 to be skewed laterally in the x-direction and thus lay generally flat with respect to itself and the upper layer 112 and lower layer 114. As such, the use of spacer fabric 111 can allow the exercise mat 110 to be stored in a compact, rolled up configuration for easy storage and transport and handling by the user, whether as a personal accessory or as equipment provided by an exercise facility, while providing robust and resilient cushioning during use when laid out in a generally planar configuration.

Figure 3A:
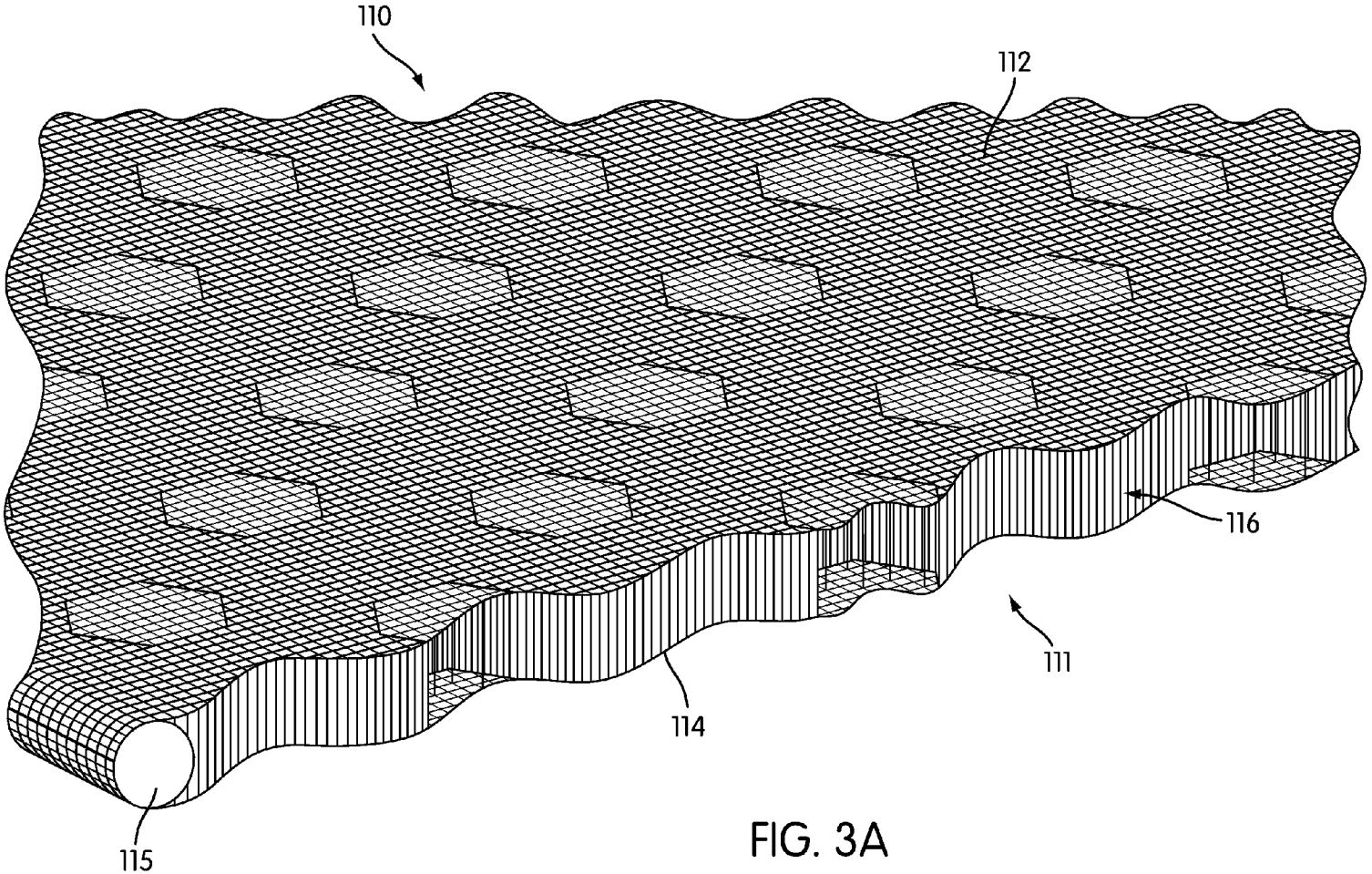
FIG. 3A is a perspective view taken from the lower left corner of the exercise mat shown in FIG. 1 illustrating a first edge seam configuration.
Figure 3B:
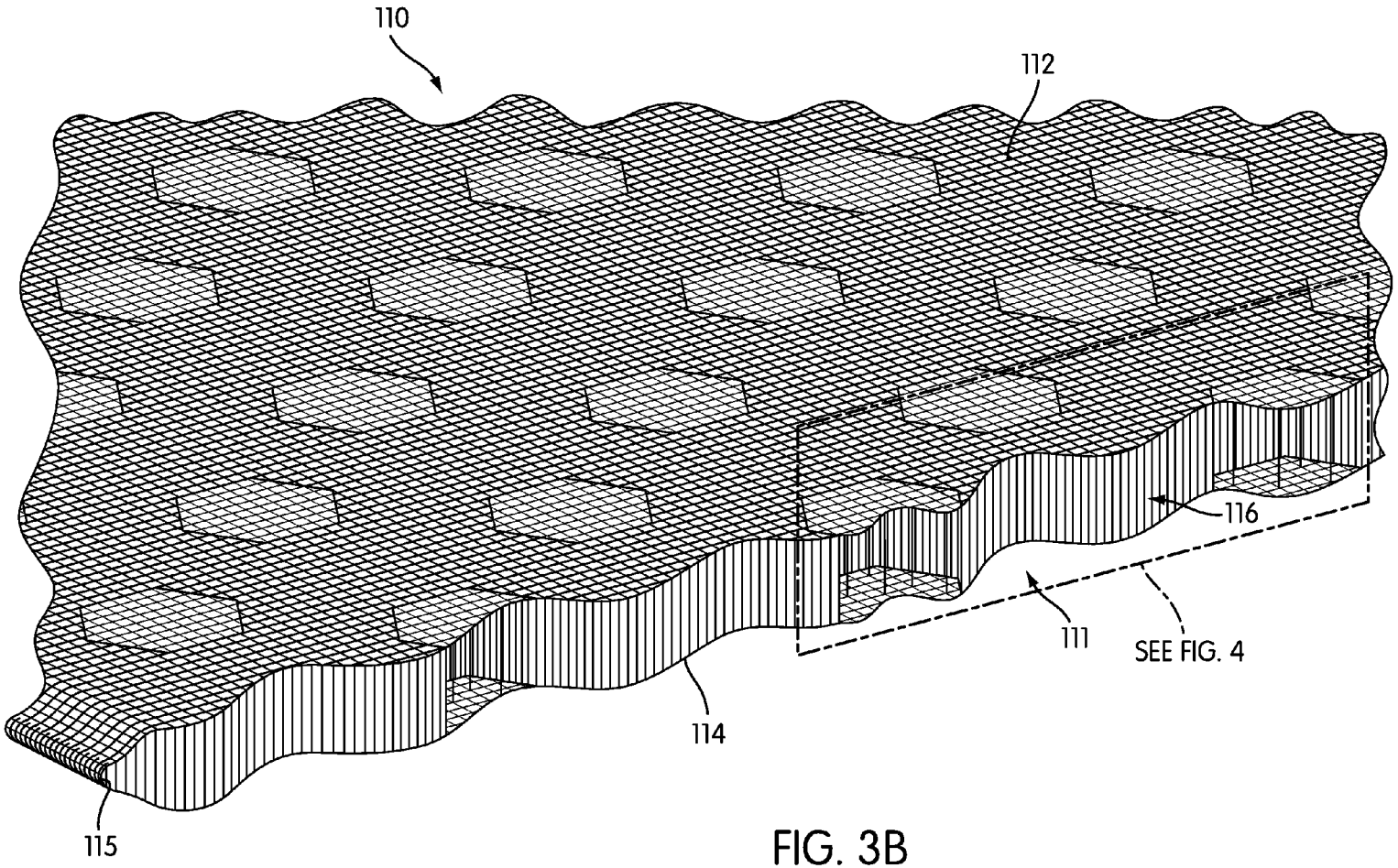
FIG. 3B is a perspective view taken from the lower left corner of the exercise mat shown in FIG. 1 illustrating a second alternative edge seam configuration.
Figure 4:
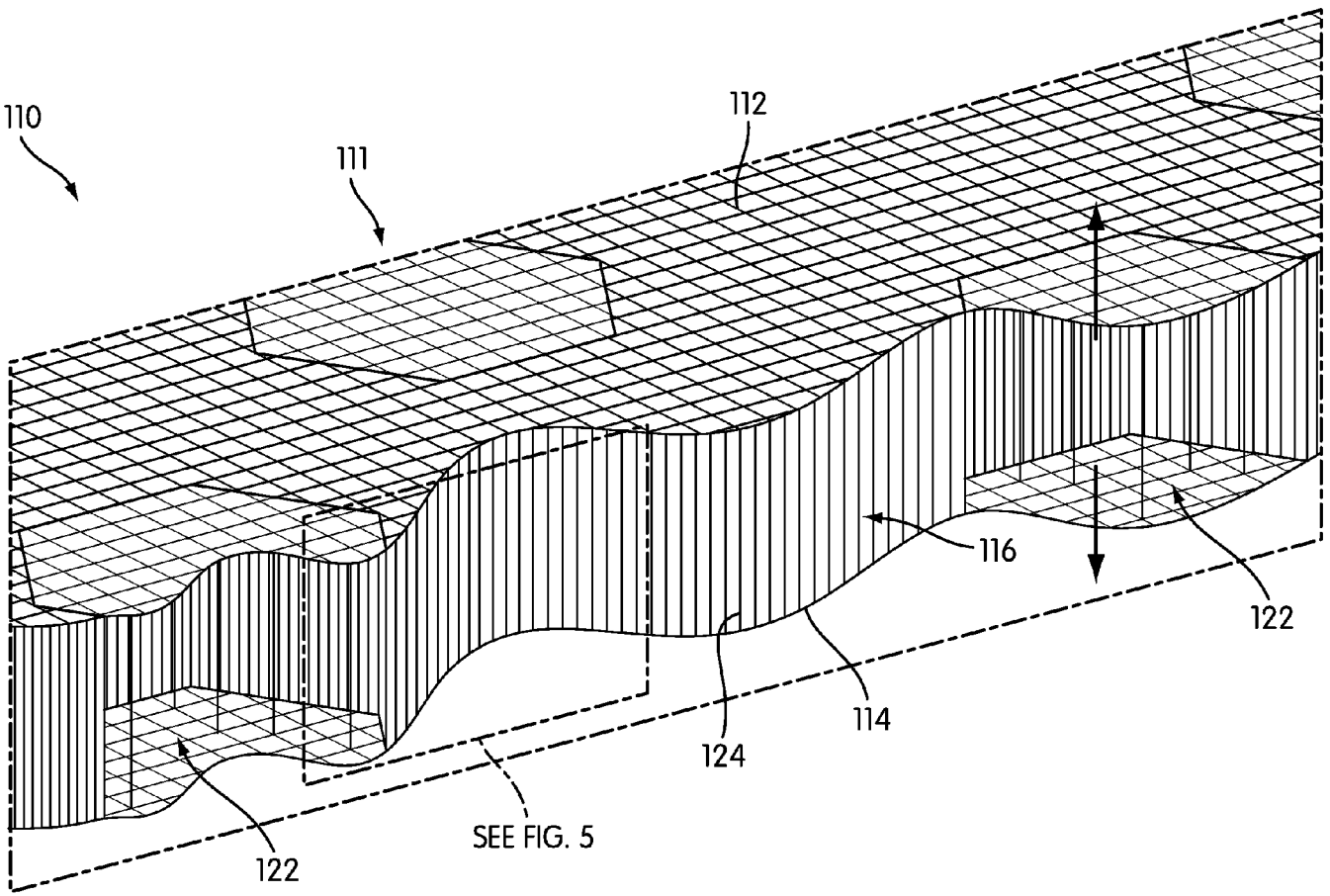
FIG. 4 is a perspective view of region 4 denoted in FIG. 3 of the exercise mat of FIGS. 1-3.

As shown in FIGS. 3A and 3B, a seam 115 can be formed around edge portions 115 of spacer fabric 111 to maintain the desired lateral arrangement between the upper and lower layers and thereby encourage the spacer fabric to return to its spaced apart configuration when unrolled from the compressed state. Seam 115 can be in various forms. For instance, as shown in FIG. 3A, seam 115 can be in the form of a sewn edge 115 retaining the upper and lower layers in the desired arrangement. As further illustrated in FIG. 3B, seam 115 can have alternative forms including a bead 115 be formed via melting the spacer fabric along its edge portions when disposed in the desired spaced apart configuration.

Figure 6:
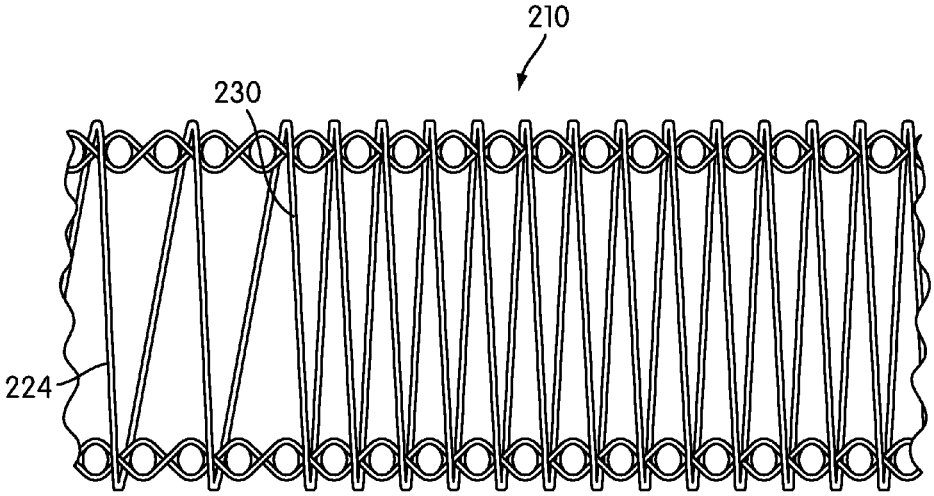
FIG. 6 is a cut away view taken from line Y-Y shown in FIG. 4 for another configuration of an exercise mat.

In addition, the use of knit spacer fabric 111 can provide for design flexibility that allows adjustability in the amount of cushioning and ventilation through the exercise mat. The density of the wall fabric 116 can be varied as desired to provide a greater or lesser degree of cushioning. In general, a higher density wall fabric 116 corresponds with a greater amount of cushioning due to an increased number of wall fabric columns biasing the upper and lower layers apart from each other. The density of wall fabric 116 can be varied via the use of various techniques for knitting the spacer fabric. For instance, as shown in FIG. 6, multiple wall fabric filaments can be used that extend between the upper and lower layers.

Further, the use of knit spacer fabric 111 can allow for regions of increased ventilation to be formed in the knit fabric. For example, the configuration of FIGS. 1-4 include a plurality of port regions 122 formed by providing a lower density of wall fabric elements 124 in the port regions. As such, air can flow more easily through the spacer fabric in those regions without significant interference from the wall fabric. Arrangements of port regions including their size, spacing, density of wall fabric therein, etc., as well as arrangements for the overall design of the spacer fabric, such as wall fabric density, color, texture, pattern and type of knit, can be varied as desired to provide exercise mats having a wide variety of characteristics for cushioning, ventilation, feel, elasticity, etc. As such, exercise mat 110 can be tailored for a particular use, sport or personal preference by varying the design of the spacer fabric.

Some embodiments of the exercise mat may include various densities created by the wall fabric elements and port regions 122. For example, in an embodiment shown in FIG. 5, the higher density wall fabric 116 passes between consecutive cylindrical elements in both the upper layer 112 and lower layer 114, while the lower density wall fabric 124 passes between non-consecutive cylindrical elements in the upper layer 112 and lower layer 114. In another embodiment 210 in FIG. 6, the transitioning wall fabric 230 passes from consecutive to non-consecutive cylindrical elements, resulting in low density wall fabric 224.

Various types of threads, filaments or yarns can be used in combinations to produce spacer fabric 111 and exercise mats 110 of varying configurations and properties. However, the use of polyester, nylon and/or combination polyester/yarn filaments are preferred for many configurations of exercise mat 110. The use of polyester, nylon and/or combination polyester/nylon filaments for the spacer fabric can provide an exercise mat 110 that provides robust cushioning during use, is lightweight, portable and easy to store, and that can be cleaned easily. Polyester and nylon are extremely resilient materials that can withstand many stresses including the temperatures and exposures to chemicals and moisture that are typically encountered during washing and drying processes of conventional washing and drying machines.

In addition, the use of polyester, nylon and/or combination polyester/nylon filaments can provide an exercise mat that can easily withstand the stresses encountered during normal use of the exercise mat 110 over extended periods without significant degradation along with allowing the user to easily clean the exercise mat by simply running it through a conventional household washer and dryer cleaning cycle, as well as through industrial washer and dryer cleaning cycles. Further, the use of these materials can provide an exercise mat capable of having a variety of desirable aesthetic and functional features including textures, patterns, colors and designs and that can resiliently retain these features through many washer and dryer cleaning cycles.

Figure 7:
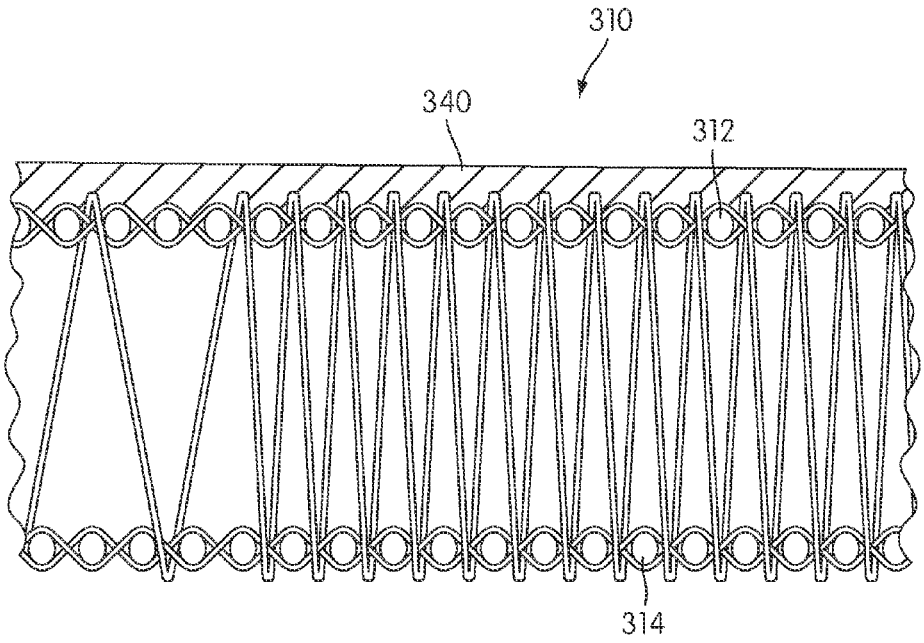
FIG. 7 is a cut away view taken from line Y-Y shown in FIG. 4 for a further configuration of an exercise mat.
Figure 8:
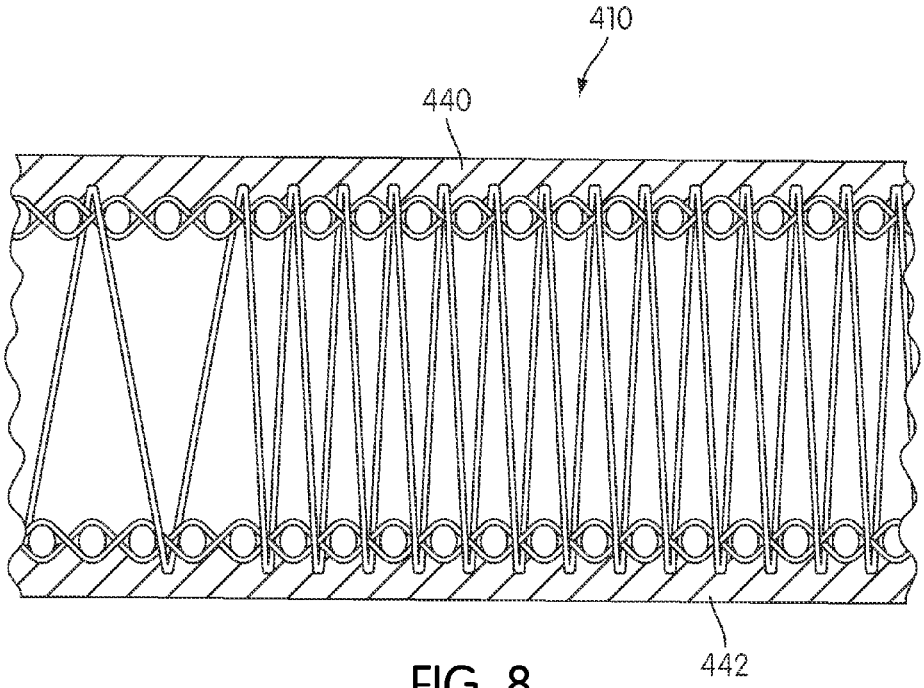
FIG. 8 is a cut away view taken from line Y-Y shown in FIG. 4 for yet another configuration of an exercise mat.

Referring now to FIGS. 7 and 8, exercise mats 310 and 410 are shown that generally include the aspects and preferences of exercise mat 110 except as discussed herein. As shown, exercise mat 310 includes a friction-enhancing, traction-enhancing, and/or moisture-repellant region 340 at its top layer 312. Although shown at its top layer, region 340 can be placed on either the top and/or bottom layer of exercise mat 310. Region 340 can include a coating, such as a silicone-based coating, that can improve the coefficient of friction between the mat and the user or the ground. Region 340 can also repel moisture, such as sweat, encountered during use to avoid reduced friction or slippage that can result from the presence of moisture. As illustrated in FIG. 8, friction-enhancing regions 440 and 442 can exist on both upper and lower outer portions of the exercise mat. Although regions 340, 440 and 442 are described herein as being able to include a traction or friction-coating, such as a silicone-based coating, it is understood that such a coating can include various types of coatings like sprayed-on materials, such as liquid silicone, a layer of beaded material, such as beaded silicone, material embedded in filaments forming portions of the mat, such as silicone-embedded or coated filaments, etc. Further, it is understood that such coatings can be fully or partially included in regions 340, 440 and/or 442 and can even extend beyond these regions, such as throughout the spacer filaments.

Figure 9:
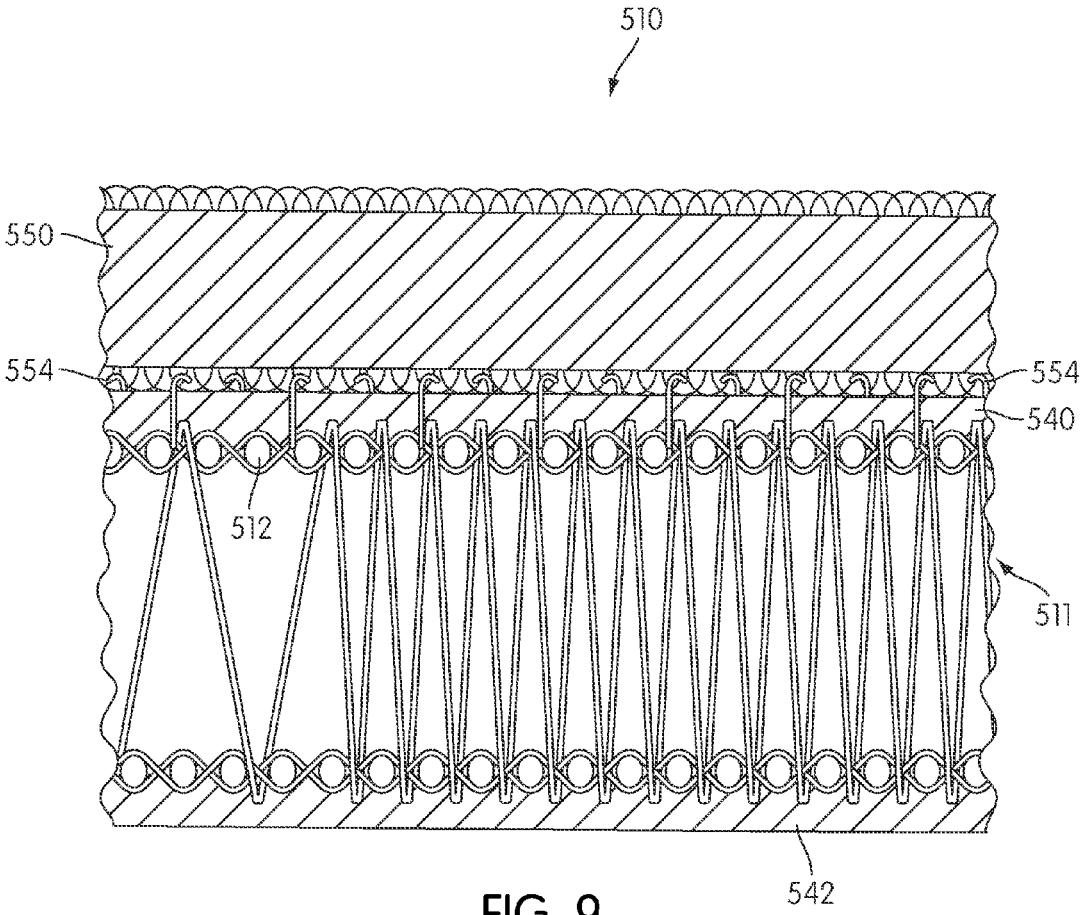
FIG. 9 is a cut away view taken from line Y-Y shown in FIG. 4 for an additional configuration of an exercise mat having a towel removably attached to one side of the mat.

FIG. 9 illustrates an exercise mat 510 having a towel 550 removably attached to at least a portion of one side the exercise mat. The towel can include one part of a hook and loop fastening mechanism attached to it and the exercise mat can include a corresponding opposite part of a hook and loop or other fastening mechanism attached to it to allow for easy removal of the towel. In one configuration (not shown), one part of one or more hook and loop fastening mechanisms could be sewn, glued or otherwise attached to an outer portion of the exercise mat. For instance, strips or patches of the hook side of a hook and loop fastener could be sewn or glued to portions of one or both sides of the mat, and opposite strips or patches could be affixed to a removable accessory. Further, although shown as towel 550, towel 550 can be one of various accessories 550 that can be removably attached to the mat. For instance, accessory 550 could be a relatively small hand or face towel, a full-length towel that can cover substantially the entire mat during use, a key pocket, a headband, a membership card or credit card pocket, etc.

Preferably, however, the exercise mat includes a spacer fabric knit 511 to include integrally hooks 554 extending from its upper layer. The hooks could be formed via looped filaments knit to extend from the upper layer 512 of the spacer fabric, which can be subsequently cut to create a pair of hooks from each loop. Also, towel 550 preferably is formed from a towel having many loops 552 along its outer surface, which can removably connect with hooks 554 to attach the towel to the exercise mat in a removable configuration. This can permit the user to maintain a towel along the top surface or a portion of the top surface of the exercise mat during use, which can be desirable for various uses such as during use as a yoga mat. In addition, a cushion or other article could be used instead of towel 550 to allow the use of other attachment accessories like a headband or storage compartments. The exercise mat may further include a friction-enhancing region 540 on upper layer and friction-enhancing region 542 to the lower layer.

Figure 10:
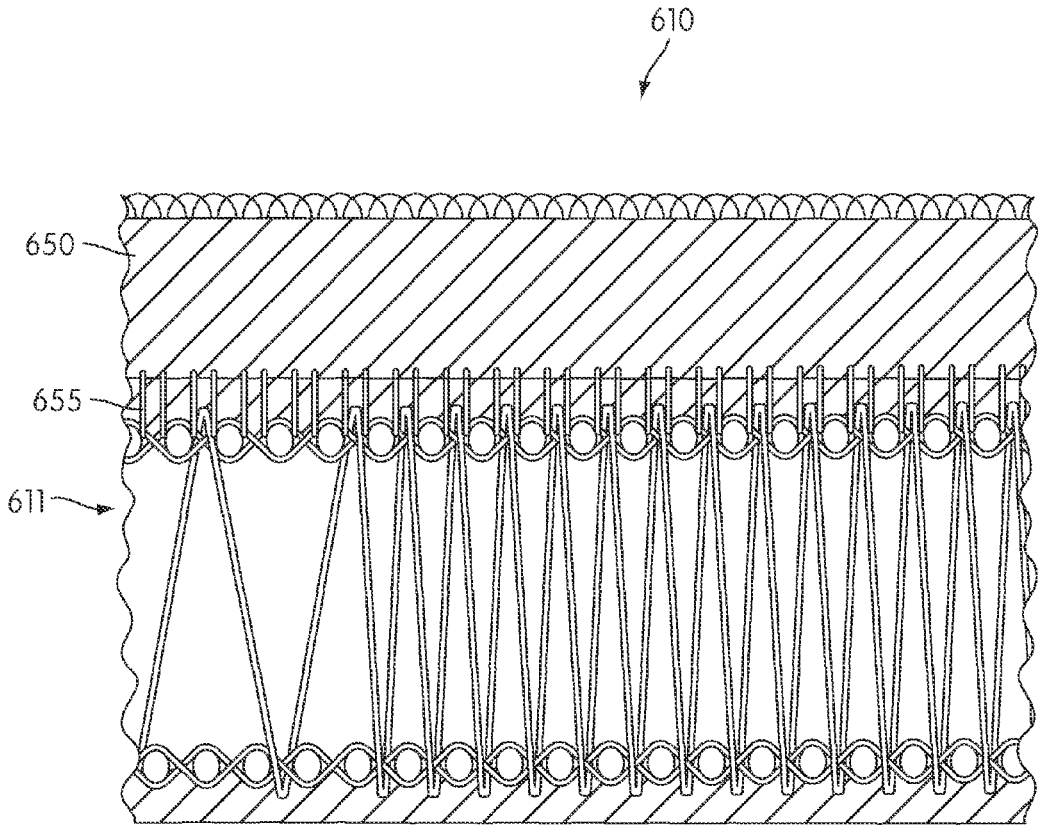
FIGS. 10 and 11 are cut away views taken from line Y-Y shown in FIG. 4 for configurations of an exercise mat having a towel fixedly attached to one side of the mat.
Figure 11:
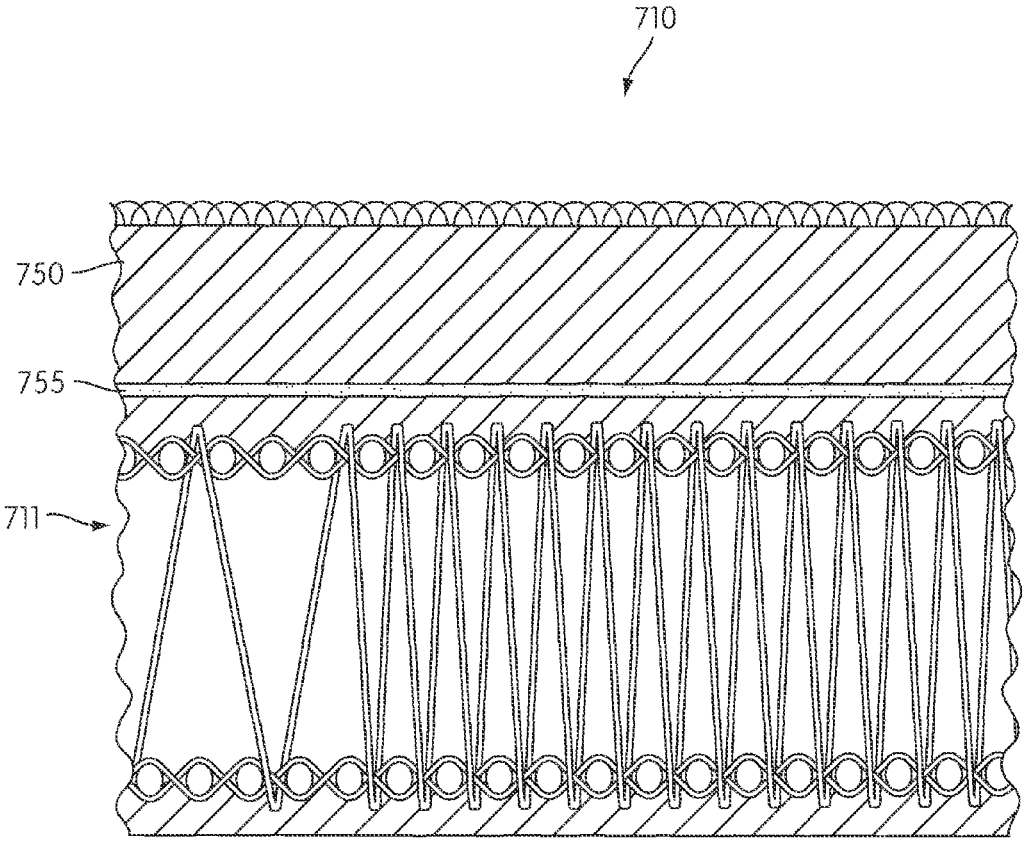

FIGS. 10 and 11 show alternative configurations for exercise mats having a towel and/or other accessory items attached. The configurations of FIGS. 10 and 11 generally include the features and preferences of FIG. 9, except as discussed below with respect to the added towel and/or accessory items. FIG. 10 shows an exercise mat 610 having a towel 650 fixedly attached to at least a portion of one side the exercise mat. FIG. 10 shows an exercise mat 610 having a towel 650 fixedly attached to at least a portion of one side the exercise mat via stitches 655. In one configuration, the stitches are arranged to allow a portion of the towel to be lifted from the mat portion 611, so the user can more easily use it to wipe their hands, face, etc. while leaving the towel connected to the mat. For example, stitches 655 may only be disposed along one edge of the towel.

FIG. 11 shows an exercise mat 710 having a towel 750 fixedly attached to at least a portion of one side of the exercise mat via an adhesive 755. Similar to exercise mat 610, towel 750 can be almost completely attached to mat portion 711, or it can be only partially attached to the mat portion so the user can lift it as desired. Although FIGS. 9-11 illustrate towels as attachments, it us understood that other configurations can include additional attachments. For instance, pockets or a storage compartment could also be fixedly or removably attached to the mat portion either with or without a towel or other accessory attachments.

Figure 12:
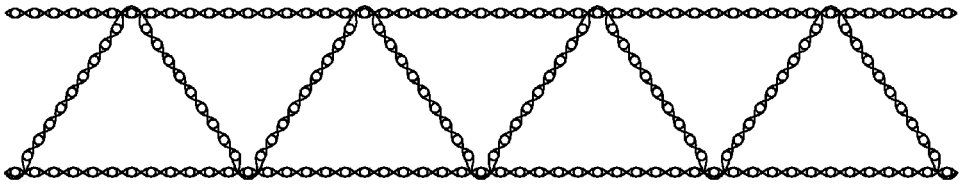
FIGS. 12-15 are sectional views of spacer fabric configurations that can be used with exercise mats discussed herein.
Figure 13:
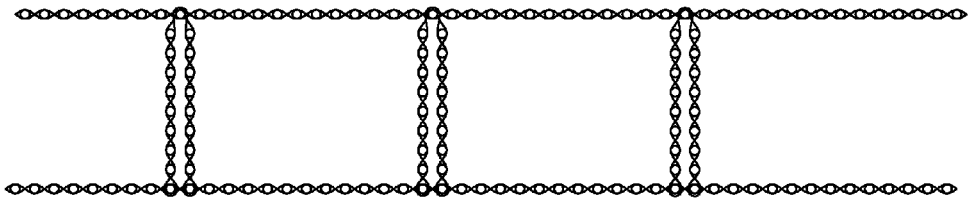
Figure 14:
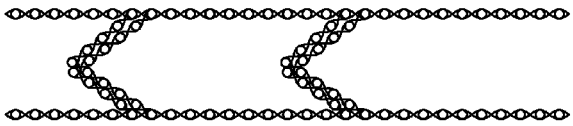
Figure 15:
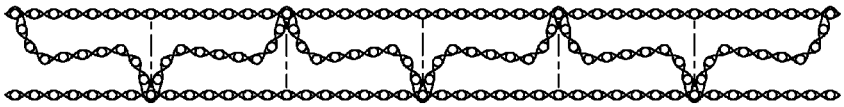

FIGS. 12-15 are sectional views that show in more detail the spacer fabric configurations that can be used with exercise mats of the present invention. Specifically, FIG. 12 illustrates an embodiment in which the wall fabric has a diagonal truss-like appearance. FIG. 13 illustrates an embodiment in which the wall fabric has a vertically orientation and is shown with spaced-apart pairs. FIG. 14 illustrates an embodiment in which the wall fabric has a bias or bend formed therein and is shown with spaced-apart pairs. FIG. 15 illustrates an embodiment in which the wall fabric has a more complex configuration such that a length is knit to the top and bottom layers so as to provide a curved, spring-like structure therebetween. Each of these configurations provides its own advantages such as enhanced thickness, cushioning, recovery, compression characteristics, design, color, pattern, texture, etc.

The invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

The invention claimed is:

1. An exercise mat comprising:

a knit spacer fabric comprising:

a first base region including a plurality of first filaments knit with a plurality of second filaments, the first base region further including an upper layer, the upper layer having a plurality of first cylindrical elements spaced throughout the first base region;

a second base region spaced apart from the first base region up to a cushion thickness distance, the second base region including a plurality of third filaments knit with a plurality of fourth filaments, the second base region further including a lower layer, the lower layer having a plurality of second cylindrical elements spaced throughout the second base region;

an intermediate spacer region disposed between the first base region and the second base region, the intermediate spacer region including a plurality of intermediate filaments extending between the first and second base regions in a columnar arrangement and forming a field of columnar filaments, the field of columnar filaments biasing the first base region apart from the second base region to the cushion thickness distance, wherein the plurality of intermediate filaments pass between the consecutive first cylindrical elements and the consecutive second cylindrical elements in one portion of the exercise mat, and wherein the plurality of intermediate filaments pass between the non-consecutive first cylindrical elements and the non-consecutive second cylindrical elements in another portion of the exercise mat; and a traction-enhancing coating disposed at least one of the first and second base regions.

2. The exercise mat of claim 1, wherein the first and second filaments are the same filaments as the third and fourth filaments.

3. The exercise mat of claim 1, wherein the knit spacer fabric includes one of a circular knit construction and warp knit construction.

4. The exercise mat of claim 1, wherein the field of columnar filaments forms a plurality of port regions between the first and second base regions, the field of columnar filaments having a first density of columnar filaments as a base density for the field of columnar filaments and the port regions having a second density of columnar filaments that is less than the first density of filaments.

5. The exercise mat of claim 4, wherein portions of the field of columnar filaments having the first density provide a first cushioning bias between the first and second base regions and the portions of the field of columnar filaments at the port regions provide a second cushioning bias between the first and second base regions that is less than the first cushioning bias.

6. The exercise mat of claim 5, wherein the first cushioning bias and the second cushioning bias together provide an overall cushioning bias for the field of columnar filaments.

7. The exercise mat of claim 6, wherein the field of columnar filaments forms an array of port regions disposed in a substantially uniform arrangement providing a substantially uniform overall cushioning bias for the field of columnar filaments.

8. The exercise mat of claim 6, wherein the field of columnar filaments forms an array of port regions disposed in a non-uniform arrangement including a first sub-array of port regions having a first configuration of the port regions and a second sub-array of port regions having a second configuration of the port regions that is different from the first sub-array, the first sub-array of port regions together with a first proximate portion of the field of columnar filaments providing a first overall cushioning bias and the second sub-array of port regions together with a second proximate portion of the field of columnar filaments providing a second overall cushioning bias that is different from the first overall cushioning bias.

9. The exercise mat of claim 1, further comprising one of a plurality of discontinuous hook filaments and a plurality of continuous loop filaments extending outward from the first base region and forming a first part of a hook and loop fastener on the first base regions and the second base regions; and the exercise mat further including an edge portion around the perimeter of the mat, the edge portion made either by sewing the first base region and second base region together, or by melting the first base region and second base region together.

10. The exercise mat of claim 9, further comprising a removable accessory having one of a plurality of loops and a plurality of hooks extending from a portion of the removable accessory and forming a second part of the hook and loop fastener for selectively attaching the removable accessory to the exercise mat.

11. The exercise mat of claim 10, wherein the removable accessory is selected from the group comprising a small hand or face towel, a full-length towel and a storage compartment.

12. The exercise mat of claim 1, wherein the field of columnar filaments in the intermediate region includes a plurality of second filaments extending between the first and second base regions.

13. The exercise mat of claim 1, wherein the plurality of intermediate filaments is selected from a group including one or more of polyester filaments, nylon filaments and combination filaments formed from nylon and polyester.

14. The exercise mat of claim 1, wherein the traction-enhancing coating forms a moisture resistant coating.

15. The exercise mat of claim 1, wherein the traction-enhancing coating includes a silicone coating at an outer portion of the at least one of the first and second base regions.

16. The exercise mat of claim 1, wherein the traction-enhancing coating includes a silicone material impregnated into one or more of the first, second, third, fourth and intermediate filaments.

17. An exercise mat comprising:

an upper layer;

a lower layer; and a three-dimensional knit spacer fabric formed from a plurality of knit polymeric threads, the three-dimensional knit spacer fabric having a first ground fabric, a second ground fabric, and a first wall fabric extending between the first ground fabric and the second ground fabric, the first wall fabric supporting the first ground fabric and the second ground fabric in a compressible spaced-apart configuration;

wherein the exercise mat is configured to be rolled up and compressed while in a rolled up configuration, to be laid out in a substantially planar configuration, and to expand into a spaced apart arrangement between the first ground fabric and the second ground fabric when in the substantially planar configuration;

wherein the first ground fabric having a first plurality of cylindrical elements spaced throughout the upper layer, and the second ground fabric having a second plurality of cylindrical elements spaced evenly throughout the lower layer;

the first wall fabric passing between consecutive upper cylindrical elements and lower cylindrical elements, and also between non-consecutive upper cylindrical elements and lower cylindrical elements; and and wherein the first wall fabric passes over and above the upper layer, and passes under and below the lower layer.

18. The exercise mat of claim 17, wherein the exercise mat is configured to be washed in a washing machine.

19. The exercise mat of claim 17, wherein the exercise mat is configured to be dried in a dryer.

20. The exercise mat of claim 17, wherein an outer surface of the lower layer includes a friction-enhancing coating.

21. The exercise mat of claim 20, wherein the friction-enhancing coating includes a silicone coating.

22. The exercise mat of claim 17, wherein a decorative print is disposed on an outer surface of at least one of the upper layer and the lower layer.

23. The exercise mat of claim 17, wherein the friction-enhancing coating is a substantially continuous coating.

24. The exercise mat of claim 17, wherein the friction-enhancing coating is a non-continuous interrupted coating forming a decorative pattern.

25. The exercise mat of claim 17, wherein the spacer fabric includes a third ground fabric and a second wall fabric supporting the second ground fabric and the third ground fabric in a compressible spaced-apart configuration.

26. The exercise mat of claim 17, wherein the spacer fabric has a base wall fabric density and a vent wall fabric density that is less than the base wall fabric density, the spacer fabric providing a plurality of regions having the lower vent wall fabric density to form a plurality of vents between the upper layer and the lower layer.

27. The exercise mat of claim 17, wherein the plurality of knit polymeric threads including threads selected from the group comprising polyester threads, nylon threads and combination polyester/nylon threads.

* * * * *